United States Patent [19]

Kern

[11] Patent Number: 5,051,223

[45] Date of Patent: Sep. 24, 1991

[54] METHOD FOR THE PRODUCTION OF CONCRETE PIPES

[76] Inventor: Gregor Kern, Bamberger Strasse 16, D-7522 Philippsburg, Fed. Rep. of Germany

[21] Appl. No.: 405,560

[22] Filed: Sep. 11, 1989

[51] Int. Cl.[5] ..... B28B 1/16; B28B 3/12; B28B 21/26

[52] U.S. Cl. ..... 264/256; 264/312; 264/333; 425/94; 425/95; 425/262; 425/427

[58] Field of Search ..... 264/256, 312, 333; 425/262, 427, 94, 95

[56] References Cited

U.S. PATENT DOCUMENTS

| | | | |
|---|---|---|---|
| 1,510,117 | 9/1924 | Von Vass | 264/256 |
| 1,669,768 | 5/1928 | Martin | 264/256 |
| 1,768,451 | 6/1930 | Hume | 264/312 X |
| 1,788,748 | 1/1931 | Schutte | 264/256 X |
| 1,838,546 | 12/1931 | Halstead | 425/262 X |
| 1,979,655 | 11/1934 | Whiting | 264/256 |
| 2,533,579 | 12/1950 | Gowing | 264/256 |
| 3,091,013 | 5/1963 | Robinson | 425/262 X |
| 3,217,077 | 11/1965 | Cocke | 264/256 |
| 3,649,727 | 3/1972 | Gauger | 264/312 X |
| 4,079,500 | 3/1978 | Tolliver | 264/312 X |
| 4,340,553 | 7/1982 | Fosse | 264/256 X |
| 4,639,342 | 1/1987 | Adly | 264/312 X |

*Primary Examiner*—Jan H. Silbaugh
*Assistant Examiner*—Karen Aflergut
*Attorney, Agent, or Firm*—Collard, Roe & Galgano

[57] ABSTRACT

A concrete pipe is produced by introducing a wet concrete mass into a pipe form to produce a cylindrical mass having an inner wall, compacting the cylindrical concrete mass by applying pressing rollers to the inner wall, smoothing the inner wall of the compacted cylindrical concrete mass, and applying a liquid impregnation medium to the inner wall under pressure after the concrete mass has been compacted, the inner wall has been partially smoothed and the concrete mass is still damp. The pressure is sufficient to cause the impregnation medium to permeate the damp concrete mass to a depth of at least 10 mm.

1 Claim, 1 Drawing Sheet

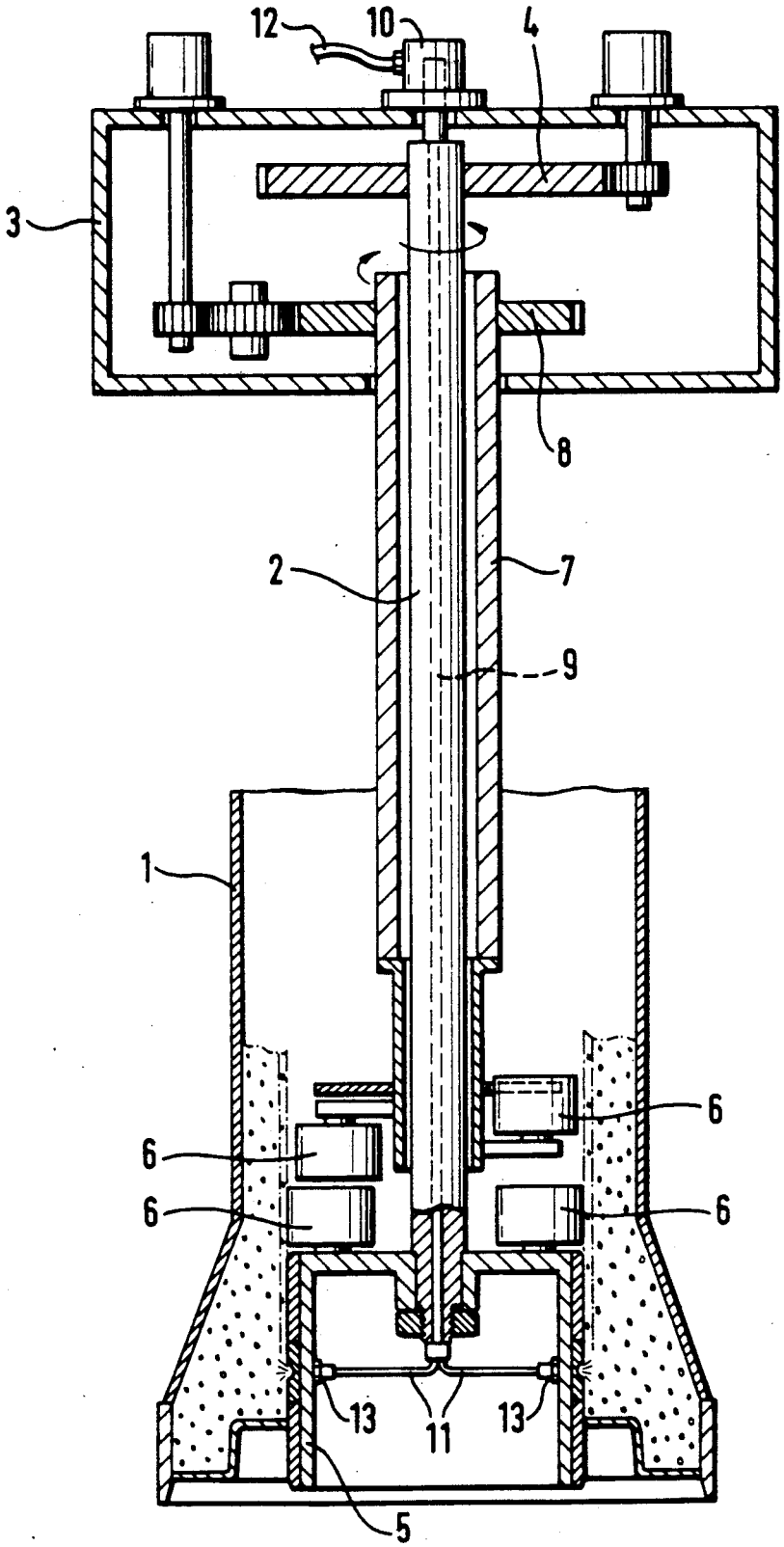
12
10
4
3
8
2
7
9
1
6
6
6
6
13
11
13
5

METHOD FOR THE PRODUCTION OF CONCRETE PIPES

The invention relates to a method for the production of concrete pipes.

The production of concrete pipes in the press-rolling technique is far from perfect, above all insofar a constancy of quality is concerned. Moreover, chemical toxicity is becoming steadily worse due to the increasing pollution of waters. In critical cases pipes have been covered with acid-proof tiles, or curved plastic plates are worked into the inner wall of the pipe in the vibrating technique. Protective layers are often added subsequently to normally produced concrete pipes by way of injection, painting, or spackling. The subsequent treatment and impregnation of these pipes has proven to be time-consuming, is extremely difficult in particular as far as narrower pipes are concerned, and has been only partially successful since the already set concrete pipe only absorbs the subsequently applied sealing material to a small extent.

It is accordingly an object of the invention to develop a method for the production of the above-described concrete pipes resulting in pipes whose inner surface is liquid-proof to a great extent and which proves to be highly wear-resistant. Moreover, there is disclosed a pipe press for directly applying this method in a single step during the production of concrete pipes.

The object is solved according to the invention by a method for the production of a concrete pipe having an inner wall, which comprises the steps of introducing a concrete mass into a pipe form to produce a cylindrical mass having an inner wall, compacting the concrete mass by applying pressing rollers to the inner wall, subsequently smoothing the inner wall of the mass, and applying an impregnation medium to the inner wall of the concrete mass under pressure after the concrete mass has been compacted, the inner wall has been partially smoothed and the concrete mass is still damp, the pressure being sufficient to cause the impregnation medium to permeate the concrete mass to a depth of at least 10 mm.

The method developed by the invention makes it possible to apply the corrosion-resistant and wear-resistant layer to the inner wall of a concrete pipe during its production, i.e., in a condition before the concrete has set. The operating pressure causes the impregnation liquid to permeate at least 10 mm into the concrete mass and completely sets there together with the concrete. The protective layer produced in such a manner has a strength and evenness which is unknown with concrete pipes subsequently impregnated, that is, after its setting. Due to its thickness, the protective layer serves after setting as an additional reinforcement of the concrete pipe. This is an additional advantage of the impregnation technique of the invention which is unknown in previously applied impregnation techniques.

Hereafter, the invention will be further described and explained with reference to an embodiment of a pipe press as illustrated in the drawing.

According to the illustrated embodiment, the pipe press comprises a vertical pipe form 1 in whose longitudinal axis a shaft 2 is arranged rotating counter-clockwise. Shaft 2 leads from a cog-wheel 4, arranged in a transmission 3, to a smoothing cylinder 5 which, together with pressing rolls 6, forms a roll head of the pipe press.

Shaft 2 is surrounded by an outer shaft 7, which rotates clockwise and leads for a cog-wheel 8 in the transmission 3 to the two upper pressing rolls 6. Through shaft 2 leads a pipe 9, the upper end of which protrudes out of transmission 3, and which is closed there by a rotator cuff 10, while the lower end of pipe 9 branches approximately in the middle of the inner chamber of smoothing cylinder 5 into an outwardly-projecting pipe network. The number of the manifold pipes 11 depends on the radius of smoothing cylinder 5, an average number being 4 to 8 manifold pipes. In smoothing cylinders with larger radii more manifold pipes can easily be provided. The manifold pipes 11 extend at the periphery of smoothing cylinder 5 into the pre-stressing nozzles 13, which lie in a ring channel running along the circumference of the smoothing cylinder.

The pipe press functions in the following manner: Simultaneously with filling the concrete into pipe form 1, which is compacted by pressig rolls 6 and smoothed by smoothing cylinder 5 along the inner wall of the concrete pipe, a synthetic resin solution as impregnation material for the concrete is introduced by means of input pipe 12 through rotator cuff 10 into pipe 9 and driven under pressure as far as to the pre-stressing nozzles in the ring channel of the smoothing cylinder 5. From the pre-stressing nozzles, the synthetic resin solution spreads in the ring channel over the entire circumference of the smoothing cylinder 5, and permeates into the partially smoothed yet damp concrete. The working pressure in pipe 9 and in the manifold pipes 11 is adjusted in such a manner that the synthetic resin solution may permeate at least 10 mm into the concrete pipe. By changing the working pressure, smaller or larger permeation depths can be realized.

Should pipe 9 become plugged while in operation, it can be upwardly extracted from shaft 2 and be replaced by a new pipe.

I claim:

1. A method for the production of a concrete pipe having an inner wall, which comprises:

(a) introducing a wet concrete mass into a pipe form to produce a cylindrical mass having an inner wall, the pipe form comprising a cylindrical outer form having a longitudinal axis;

(b) compacting the cylindrical concrete mass by applying pressing rollers to the inner wall;

(c) introducing a rotating roller head into the pipe form along the longitudinal axis thereof, the roller head comprising the pressing rollers and a smoothing cylinder therebelow, the smoothing cylinder having a circumferentially extending wall, rotation of the roller head causing the cylindrical concrete mass to be first compacted by the pressing rollers and then smoothed by the smoothing cylinder for smoothing the inner wall of the compacted cylindrical concrete mass; and (d) applying a liquid impregnation medium to the inner wall under pressure after the concrete mass has been compacted, the inner wall has been partially smoothed, and while the concrete mass is still damp, the applying of the impregnation medium to the inner wall being through the smoothing cylinder wall and over the entire circumference of the smoothing cylinder wall with the pressure being sufficient to cause the impregnation medium to permeate the damp concrete mass to a depth of at least 10 mm.

* * * * *